US007600836B2

(12) United States Patent
Masuda

(10) Patent No.: US 7,600,836 B2
(45) Date of Patent: Oct. 13, 2009

(54) PRINTHEAD DRIVING METHOD FOR PRINTHEAD WITH REFERENCE VOLTAGE SOURCE, VOLTAGE DIVIDER, AND DIFFERENTIAL AMPLIFIER

(75) Inventor: Kazunori Masuda, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 279 days.

(21) Appl. No.: 11/617,867

(22) Filed: Dec. 29, 2006

(65) Prior Publication Data

US 2007/0109335 A1 May 17, 2007

Related U.S. Application Data

(62) Division of application No. 10/896,074, filed on Jul. 22, 2004, now Pat. No. 7,290,848.

(30) Foreign Application Priority Data

Aug. 5, 2003 (JP) ..... 2003-287139

(51) Int. Cl.
*B41J 29/38* (2006.01)

(52) U.S. Cl. ..... 347/10

(58) Field of Classification Search ..... 347/10
See application file for complete search history.

(56) References Cited

U.S. PATENT DOCUMENTS 4,313,124 A 1/1982 Hara
4,345,262 A 8/1982 Shirato et al.
4,463,359 A 7/1984 Ayata et al.
5,731,828 A 3/1998 Ishinaga et al.
6,302,507 B1 * 10/2001 Prakash et al. ..... 347/14
6,575,548 B1 6/2003 Corrigan, III et al.
2002/0145639 A1 * 10/2002 Masuda et al. ..... 347/14

FOREIGN PATENT DOCUMENTS

JP 8-118628 5/1996

* cited by examiner

*Primary Examiner*—Matthew Luu
*Assistant Examiner*—Brian J Goldberg
(74) *Attorney, Agent, or Firm*—Fitzpatrick, Cella, Harper & Scinto

(57) ABSTRACT

A printhead driving method in a power source device to output a printhead driving voltage, for generating an optimum voltage for a characteristic of the printhead attached to a printing apparatus, without controlling an output voltage with high accuracy. The printhead is provided with a reference voltage source to set an output voltage of a head driving power source. A head driving power circuit incorporated in the printing apparatus compares a value obtained by dividing the reference voltage with a value obtained by dividing the output voltage from the power circuit and performs control so as to eliminate an error. Further, the printhead is provided with a non-volatile memory, and data to supply driving energy to optimize a discharge characteristic of the printhead is obtained upon final test of manufacturing process by using a test device having a similar construction to that of the head driving power circuit incorporated in the printing apparatus. The data is written into the non-volatile memory. When the printhead is attached to the printing apparatus, the data is read from the memory and a driving pulse used in actual printing is determined based on the data.

2 Claims, 11 Drawing Sheets

PRINTHEAD DRIVING METHOD FOR PRINTHEAD WITH REFERENCE VOLTAGE SOURCE, VOLTAGE DIVIDER, AND DIFFERENTIAL AMPLIFIER

This is a divisional application of application Ser. No. 10/896,074, filed on Jul. 22, 2004, now pending.

FIELD OF THE INVENTION

This invention relates to a printhead and a printhead driving method, and more particularly, to a printhead driving method for driving a printhead mounted in an inkjet printing apparatus.

BACKGROUND OF THE INVENTION

In driving of printhead mounted in an inkjet printing apparatus, it is necessary to accurately control energy applied to the printhead, since a change of amount of ink discharged from an inkjet printhead (hereinbelow, referred to as a "printhead") may cause density unevenness in a printed image or variation of image quality due to individual difference of printing apparatus. Further, in a case where the driving energy applied to the printhead is insufficient, ink discharge failure may occur, or in a case where the energy is oversupplied, the life of the printhead may be shortened.

Accordingly, the accuracy of printhead driving voltage must be suppressed to about ±1% of rated voltage.

Generally, to set an output voltage in a power circuit, a semiconductor band-gap voltage is used as a reference voltage. As the accuracy of the band-gap voltage is about ±2%, to realize the ±1% accuracy required in the driving power supply, conventionally the output voltage is controlled by using a variable resistor or the like during manufacturing process of a printhead driving power supply circuit.

On the other hand, the printhead, having a structure removable from the printing apparatus main body, is generally manufactured separately from the printing apparatus main body.

For example, in a thermal inkjet printer in which electric energy is applied to electrothermal transducers provided around ink channels to cause heat and to discharge ink with bubbles formed by the heat, even though the same driving voltage and the same driving pulse are applied, a constant ink discharge amount cannot be obtained due to manufacturing variations in resistor values of the electrothermal transducers and/or the thickness of insulating films between the electrothermal transducers and an ink chamber.

Accordingly, the variations in the manufacturing process are reduced by conducting an ink discharge test upon manufacturing and controlling the driving voltage to attain a constant discharge amount.

Recently, an optimum driving condition is measured in an ink discharge test conducted upon manufacturing a printhead, and this condition is set for the printhead (See Japanese Patent Application Laid-Open No. 8-118628).

However, the above conventional art has the following problems.

(1) Generally, the driving power circuits installed in the printhead and the printing apparatus are separately manufactured. Upon manufacturing the printhead, accurate ink discharge measuring test is conducted, and an optimum driving condition is set for each printhead. Accordingly, accurate voltage control is made in the power circuit used in the test device. On the other hand, upon manufacturing the driving power source of the printing apparatus main body, a process of controlling the accuracy of output voltage to about ±1% of rated voltage is required. That is, control processes are required in the respective power circuit of the printhead test device and the driving power circuit of the printing apparatus main body to ensure the absolute voltage accuracy. Further, as high-quality components must be used as constituent parts of the power circuits, the total costs are increased.

(2) The setting accuracy of driving voltage in the test device used upon measuring a printhead driving condition and that of driving power of the printing apparatus main body, respectively within 1% to 1.5% variations, must be tolerated for the sake of practical use. Accordingly, there is a relative 2% to 3% error between the voltages set in these power circuits. For this reason, upon designing a printhead, the driving condition must be designed in consideration of the error, and as a result, energy may be oversupplied to the printhead in a commercially practical product. Such energy oversupply is undesirable in view of the life span of printhead.

SUMMARY OF THE INVENTION

Accordingly, the present invention is conceived as a response to the above-described disadvantages of the conventional art.

For example, a printhead driving method according to the present invention is capable of supplying appropriate amount of driving energy to a printhead without any negative effect on the life span of the printhead.

According to one aspect of the present invention, preferably, there is provided a printhead driving method for driving a printhead having plural printing elements and a reference voltage source capable of outputting a reference voltage to the outside, comprising the step of: in a case where the printhead is mounted to a printing apparatus, setting a driving voltage to be supplied from a driving power supply circuit of the printing apparatus so as to drive the plural printing elements in the printhead, based on the reference voltage inputted from the reference voltage source.

Further, the present invention may be realized as a printhead test device for testing the printhead. The printhead test device has the following construction.

That is, there is provided a printhead test device for determining an optimum driving pulse to drive a printhead, having plural printing elements, a reference voltage source capable of outputting a reference voltage to the outside, and a non-volatile memory for storing a discharge characteristic, comprising: driving control means having the same construction as that of a driving control circuit of a printing apparatus to which the printhead is mounted; driving power supply means having the same construction as that of a driving power supply circuit of the printing apparatus; input means for inputting the reference voltage from the reference voltage source; setting means for setting a driving voltage to be supplied from the driving power supply means so as to drive the plural printing elements of the printhead, based on the reference voltage inputted by the input means; test printing means for performing test printing by supplying a test signal and a driving pulse to the printhead while applying the driving voltage set by the setting means to the plural printing elements; and writing means for writing data to set an optimum driving pulse obtained by the test printing means into the non-volatile memory of the printhead.

It is desirable that the printhead test device be used in a test at a final process of manufacturing the printhead.

Further, it may be arranged such that the reference voltage of the reference voltage source in the printhead is a band-gap voltage provided in a semiconductor device where the plural printing elements are formed or a band-gap voltage provided in a semiconductor device of the non-volatile memory.

Further, it is desirable that the printhead further have a differential amplifier to compare the driving voltage or a voltage obtained by dividing the driving voltage with the reference voltage from the reference voltage source and output an error.

Further, it is desirable that the printhead be an inkjet printhead to perform printing by discharging ink, and in such case, the inkjet printhead has an electrothermal transducer to generate thermal energy to be applied to the ink for ink discharge by utilizing the thermal energy.

It is also desirable that the printhead according to the present invention be capable of setting the driving voltage with high accuracy.

More specifically, the printhead used for printing on a print medium preferably comprises: a printing element to perform printing; a reference voltage source to generate a reference voltage; and a terminal to output the reference voltage to the outside of the printhead.

Further, the present invention may be realized with a printing apparatus to perform printing by using the printhead having the above construction.

In such case, the printing apparatus has a carriage holding the printhead to scan the printhead, and the carriage has a driving control circuit to drive the printhead and a driving power supply circuit.

In the printing apparatus, the printhead is attachable/removable to/from the carriage.

The invention is particularly advantageous since the same reference voltage source in the printhead is used in the printhead test and in actual printing, thereby the errors of the reference voltage in the printing apparatus and the test device can be prevented, and further, even there are variations in respective printheads, the driving voltage from the printhead test device and that from the printing apparatus are relatively approximately the same. Further, as a value based on this voltage is written as a printhead optimum driving condition into the non-volatile memory, the printing apparatus operates always under an optimum driving condition without voltage control of the power circuits in the printhead test device and the printing apparatus.

Thus, as appropriate driving energy can be supplied to the printhead without any negative effect on the life span of the printhead, the invention contributes to the long life span of the printhead.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Note that in the following embodiments, a printer using a printhead in conformity with an inkjet method is employed.

In this specification, the terms "print" and "printing" not only include the formation of significant information such as characters and graphics, but also broadly include the formation of images, figures, patterns and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood and leather, capable of accepting ink.

Furthermore, the term "ink" (to be also referred to as "liquid" hereinafter) should be broadly interpreted similar to the definition of "print" described above. That is, "ink" includes a liquid which, when applied onto a print medium, can form images, figures, patterns and the like, can process the print medium, and can process ink (e.g., can solidify or insolubilize a coloring agent contained in ink applied to the print medium).

Furthermore, unless otherwise stated, the term "nozzle" generally means a set of a discharge orifice and a liquid channel connected to the orifice and an element to generate energy utilized for ink discharge.

<Inkjet Printing Apparatus (FIG. 1)>

Figure 1:
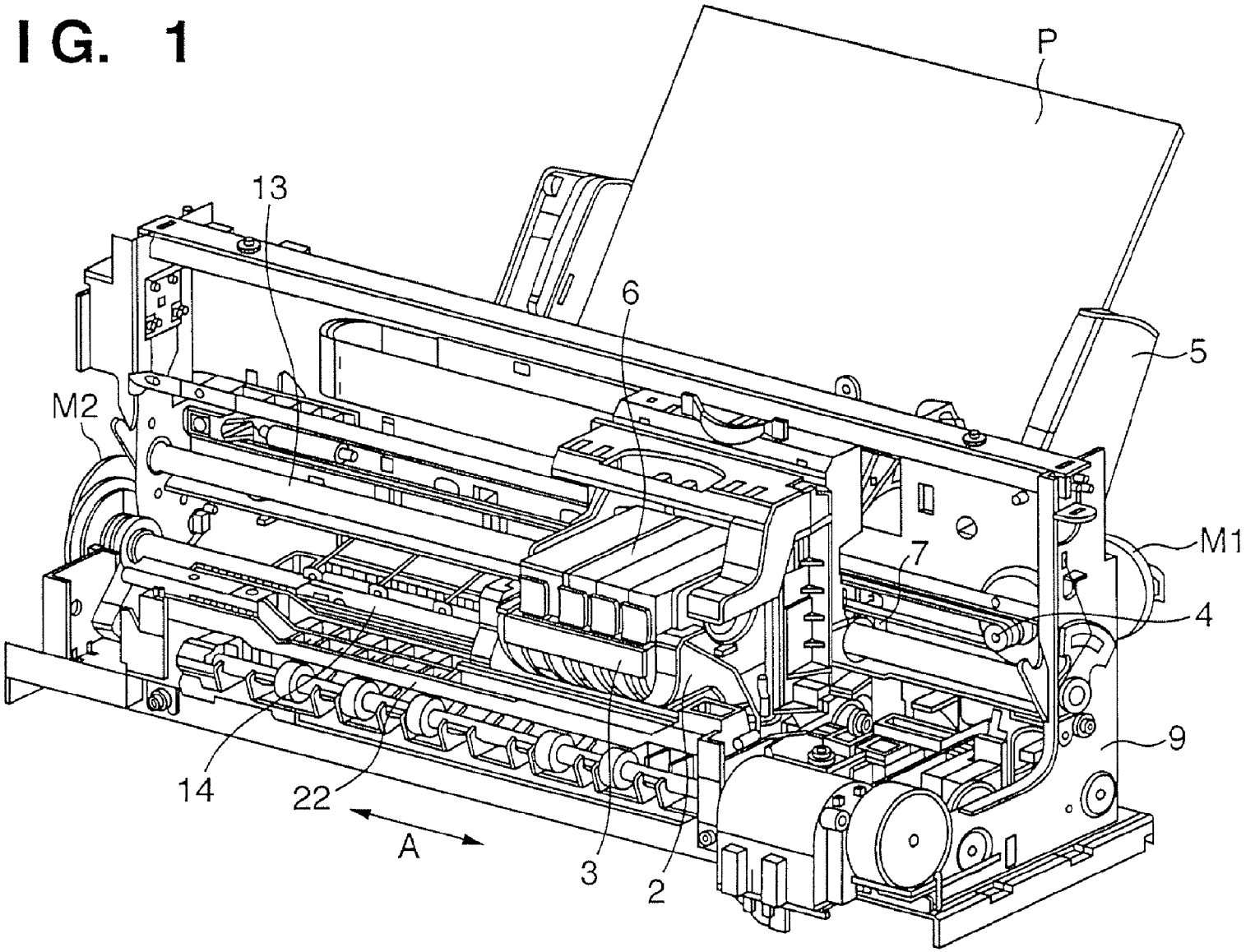
FIG. 1 is a perspective view showing the structure around a carriage of an inkjet printing apparatus as a typical embodiment of the present invention.

FIG. 1 is a perspective view showing an external appearance of the configuration of an inkiet printing apparatus 1 which is a typical embodiment of the present invention.

The inkjet printing apparatus 1 (hereinafter referred to as the printer) shown in FIG. 1 performs printing in the following manner. Driving force generated by a carriage motor M1 is transmitted from a transmission mechanism 4 to a carriage 2 incorporating a printhead 3, which performs printing by discharging ink in accordance with an inkjet method, and the carriage 2 is reciprocally moved in the direction of arrow A. A printing medium P, e.g., printing paper, is fed by a paper feeding mechanism 5 to be conveyed to a printing position, and ink is discharged by the printhead 3 at the printing position of the printing medium P, thereby realizing printing.

To maintain an excellent state of the printhead 3, the carriage 2 is moved to the position of a recovery device 10, and discharge recovery processing of the printhead 3 is intermittently performed.

In the carriage 2 of the printer 1, not only the printhead 3 is mounted, but also an ink cartridge 6 reserving ink to be supplied to the printhead 3 is mounted. The ink cartridge 6 is attachable/detachable to/from the carriage 2.

The printer 1 shown in FIG. 1 is capable of color printing. Therefore, the carriage 2 holds four ink cartridges respectively containing magenta (M), cyan (C), yellow (Y), and black (K) inks. These four cartridges are independently attachable/detachable.

Appropriate contact between the junction surfaces of the carriage 2 and the printhead 3 can achieve necessary electrical connection. By applying energy to the printhead 3 in accordance with a printing signal, the printhead 3 selectively discharges ink from plural discharge orifices, thereby performing printing. In particular, the printhead 3 according to this embodiment adopts an inkjet method which discharges ink by utilizing heat energy. A pulse voltage is applied to an electrothermal transducer corresponding to a print signal, and ink is discharged from the corresponding discharge orifice.

Further, in FIG. 1, numeral 14 denotes a conveyance roller driven by a conveyance motor M2 for conveying the printing medium P.

<Control Construction of Inkjet Printing Apparatus (FIG. 2)>

Figure 2:
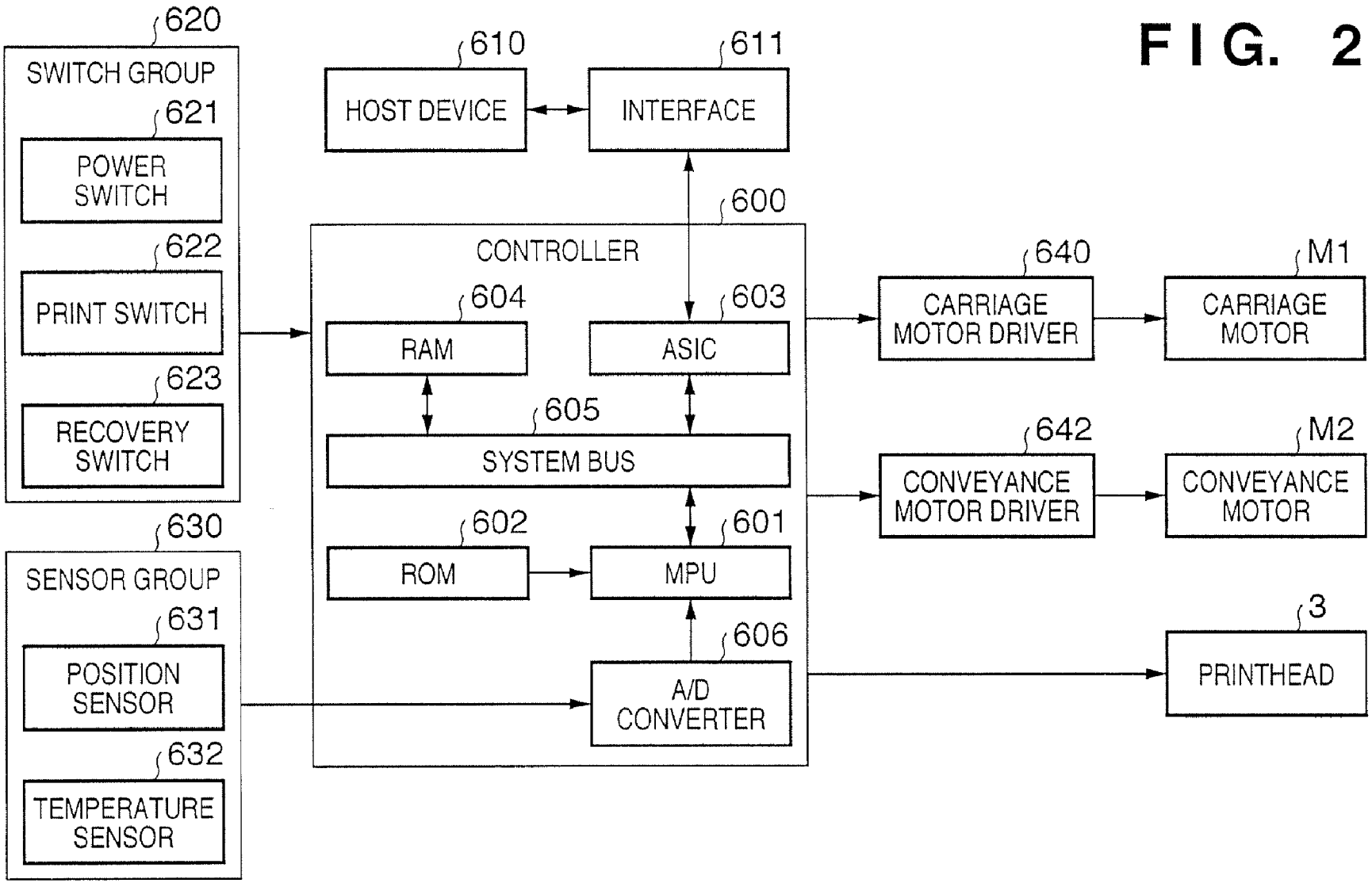
FIG. 2 is a block diagram showing the control construction of the printing apparatus in FIG. 1.

FIG. 2 is a block diagram showing a control structure of the printer shown in FIG. 1.

Referring to FIG. 2, a controller 600 comprises: an MPU 601; ROM 602 storing a program corresponding to the control sequence which will be described later, predetermined tables, and other fixed data; an Application Specific Integrated Circuit (ASIC) 603 generating control signals for controlling the carriage motor M1, conveyance motor M2, and printhead 3; RAM 604 providing an image data developing area or a working area for executing a program; a system bus 605 for mutually connecting the MPU 601, ASIC 603, and RAM 604 for data transmission and reception; and an A/D converter 606 performing A/D conversion on an analog signal inputted by sensors which will be described later and supplying a digital signal to the MPU 601.

In FIG. 2, numeral 610 denotes a computer serving as an image data supplying source (or an image reader, digital camera or the like), which is generically referred to as a host unit. Between the host unit 610 and printer 1, image data, commands, status signals and so forth are transmitted or received via an interface (I/F) 611.

Numeral 620 denotes switches for receiving commands from an operator, which includes a power switch 621, a print switch 622 for designating a print start, and a recovery switch 623 for designating a start of the processing (recovery processing) aimed to maintain an excellent ink discharge state of the printhead 3. Numeral 630 denotes sensors for detecting an apparatus state, which includes a position sensor 631 such as a photo-coupler for detecting a home position h, and a temperature sensor 632 provided at an appropriate position of the printer for detecting an environmental temperature.

Numeral 640 denotes a carriage motor driver which drives the carriage motor Ml for reciprocally scanning the carriage 2 in the direction of arrow A. Numeral 642 denotes a conveyance motor driver which drives the conveyance motor M2 for conveying the printing medium P.

When the printhead 3 is scanned for printing, the ASIC 603 transfers driving data (DATA) of the printing element (discharge heater) to the printhead 3 while directly accessing the storage area of the RAM 602.

Figure 3:
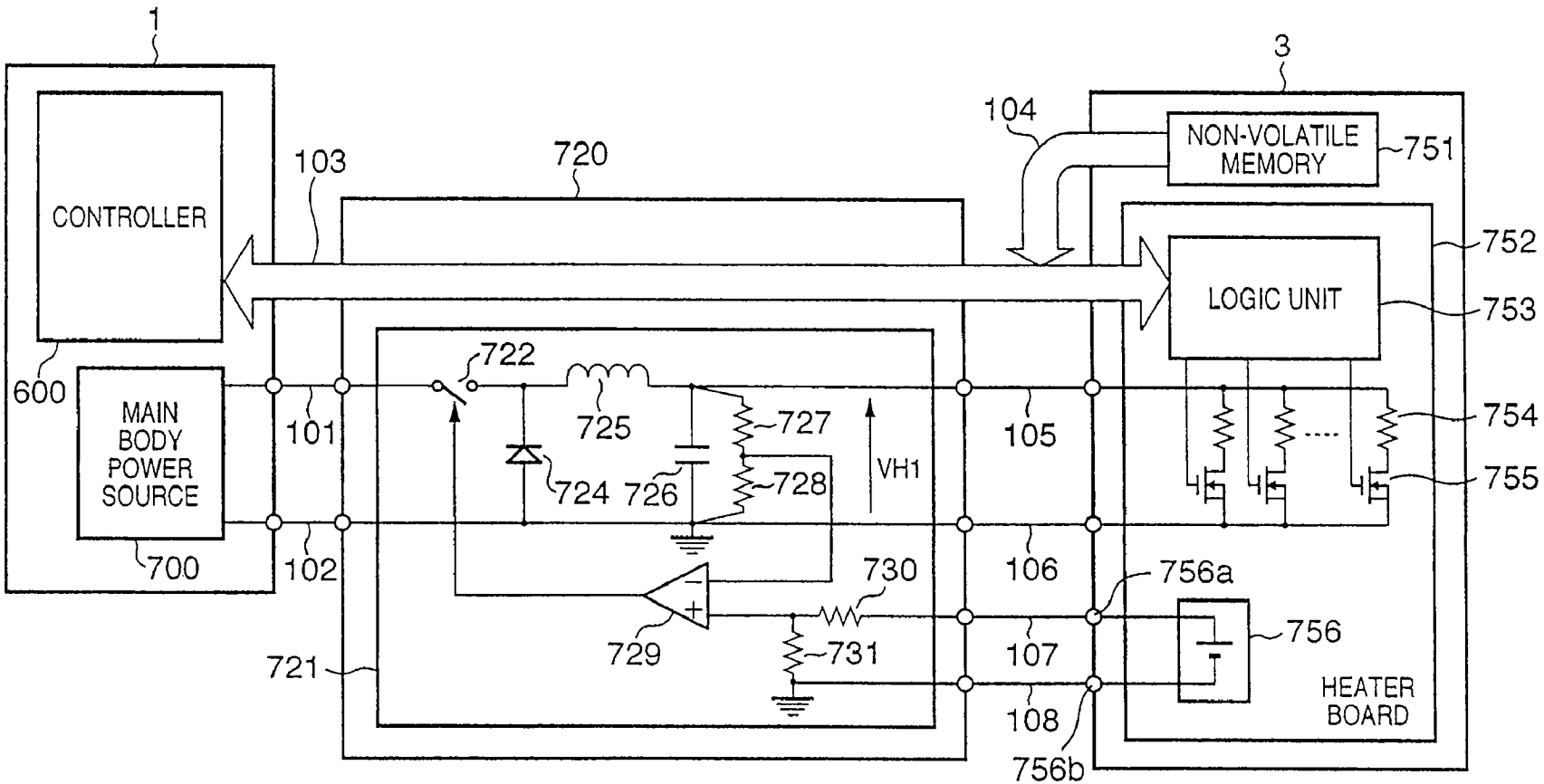
FIG. 3 is a general block diagram showing signals to a printhead and power supply circuits.

FIG. 3 is a general block diagram showing signals to a printhead and power supply circuits.

In FIG. 3, numeral 700 denotes a main power unit of the printing apparatus 1 (hereinbelow, referred to as a "main body power source"); 720, a carriage board attached to the carriage 2 to support the printhead 3 and move along a main scanning direction with respect to the print medium P to perform a printing operation; and 721, a printhead driving power source (hereinbelow, referred to as a "head driving power") which is a step-down DC/DC converter provided on the carriage board 720.

Further, the printhead 3 includes a non-volatile memory 751 storing characteristic information 104 of the printhead and a heater board (device board) 752 where various circuits are built-in on a silicone substrate by semiconductor manufacturing process. Further, the printhead 3 is an integrated unit where an ink supply orifice from an ink tank, ink channels, ink discharge orifices and the like are integrated. Electrothermal transducers (printing elements or heaters) 754 to apply thermal energy to ink, switch devices 755 such as MOS-FETs to energize the electrothermal transducers 754, a logic circuit 753 to drive the switch devices 755 based on a print signal and a control signal 103 from the controller 600 of the printing apparatus, a reference voltage source 756 to generate a reference voltage Vref from a semiconductor band-gap voltage, and the like, are formed on the heater board 752. Further, the voltage generated by the reference voltage source 756 is outputted to the outside via output terminals 756*a* and 756*b*.

Note that in FIG. 3, only one heater board is included in the printhead 3, however, generally, to print a color image by discharging magenta (M), cyan (C), yellow (Y) and black (K) inks, plural heater boards corresponding to the respective colors are provided in the printhead 3.

The printhead driving power source 721 is supplied with electric power from the main body power source 700 via power supply lines 101 and 102. The reference voltage Vref is supplied from the heater board 752 via voltage supply lines 107 and 108 to the head driving power source 721, and divided by resistors 730 and 731 to a V(+) voltage. On the other hand, an output voltage VH1 applied to the electrothermal transducers (heaters) 754 via a power line 105 and a GND line 106 is divided by resistors 727 and 728 to a voltage V(−). These voltages V(+) and V(−) are inputted into a differential amplifier 729 and compared with each other. The output voltage VH1 is determined by controlling duty ratio (ratio of the on-time to switching period) of a switch device 722 such that the difference between the voltages V(+) and V(−) is eliminated.

Further, in FIG. 3, numeral 724 denotes a diode; 725, a coil; and 726, a capacitor.

Next, the determination of driving voltage or driving energy applied to the heater will be described.

To drive one of the plural printing elements provided in the printhead 3, several μJ (Joule) electric energy is required. The energy is obtained by applying a driving pulse to the heater for about 1 μsec, and as a result, ink is discharged from the nozzle.

In order for an ink discharge amount to be always constant, this energy must be applied neither too much nor too little to the heater.

However, as the heater board has variations in heater resistor value and thicknesses of an insulating film and/or a protection film between the heater and an ink chamber caused during a heater board manufacturing process, even though a predetermined voltage with a predetermined pulse width is applied, it cannot attain a constant ink discharge amount. Accordingly, discharge amount control, in which the difference in ink discharge characteristic in each heater board due to variation in manufacturing process is detected, the driving pulse width or driving voltage is controlled in order for a discharge amount to be always constant and optimum electric energy is applied to the heater, is performed by using the printhead, the driving power and the controller of the printing apparatus main body. Note that the ink discharge characteristic specific to each heater board is obtained at a test process to be described later, and information on the ink discharge characteristic is stored into the non-volatile memory 751.

Actually, when the printhead 3 is attached to the carriage 2 in the printing apparatus 1 and an image is to be printed, data to set the driving pulse is read from the non-volatile memory 751 in the printhead 3 via a reading signal line 104, and is supplied to the controller 600 via the signal line 103. In response to the supplied information, the controller 600 sets a driving pulse to optimize the driving energy for the attached printhead 3, and transmits the driving pulse together with image data and block selection data to the printhead 3. In this manner, the printhead 3 is supplied with optimum energy to drive the printing element, and an image is printed.

The head driving power source 721 to drive the heaters 754 has the same circuit construction as that of a power circuit provided in a test device to be described below, accordingly, an optimum driving voltage VH1 can be determined.

Figure 4:
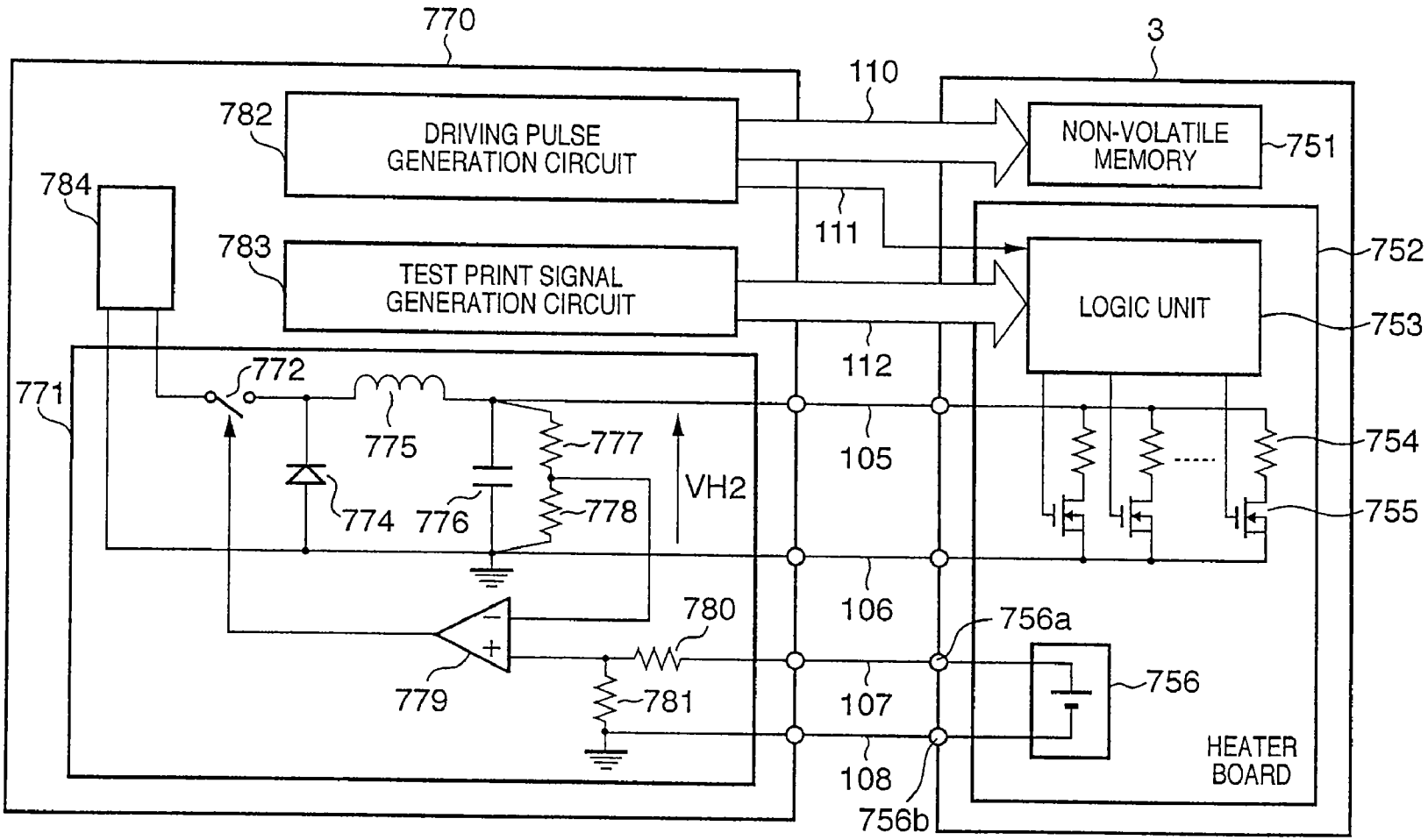
FIG. 4 is a block diagram showing the construction of a test circuit 770 to detect a variation in ink discharge characteristic in each printhead and control a driving pulse width to an optimum value.

FIG. 4 is a block diagram showing the construction of a test circuit 770 to detect the variation in ink discharge characteristic in each printheads and control a driving pulse width to an optimum value.

As it is understood from a comparison between FIGS. 3 and 4, the printhead test power source (hereinbelow, referred to as a "head test power source") 771 has the same circuit construction as that of the head driving power source 721.

Further, in FIG. 4, the head test power source 771, a driving pulse generation circuit 782, a test print signal generation circuit 783 and the like are supplied with necessary electric power from a test power source 784. Further, the printhead in FIG. 4 is the same as that in FIG. 3. Elements 772 and 774-776 in FIG. 4 correspond to elements 722 and 724-726 in FIG. 3, respectively.

In the test power of the test device, an output voltage VH2 is determined in a similar manner to the determination of the output voltage VH1 in the carriage board of the printing apparatus. Note that even if the absolute value of the reference voltage (Vref) of a reference voltage source 756 is varied, as the output voltage VH2 from the head test power source 771 relatively matches the output voltage VH1 from the head driving power source 721 in the printing apparatus, the error can sufficiently be tolerated without controlling the output voltages from the respective power circuits. That is, the error in the driving energy appears merely within accuracy of variation of the resistors 727, 728, 730 and 731 provided on the carriage board 720 and resistors 777, 778, 780 and 781 provided in the test device 770. Accordingly, the energy error can be reduced to 1% or less by using a resistor with 0.5% accuracy to a prescribed resistor value.

The printhead performs the following test upon manufacturing, to determine optimum driving pulse width data, and stores the data into the non-volatile memory 751. Note that as the data stored in the non-volatile memory 751, data to set the driving voltage in place of the data to set the driving pulse width may be stored.

Figure 5:
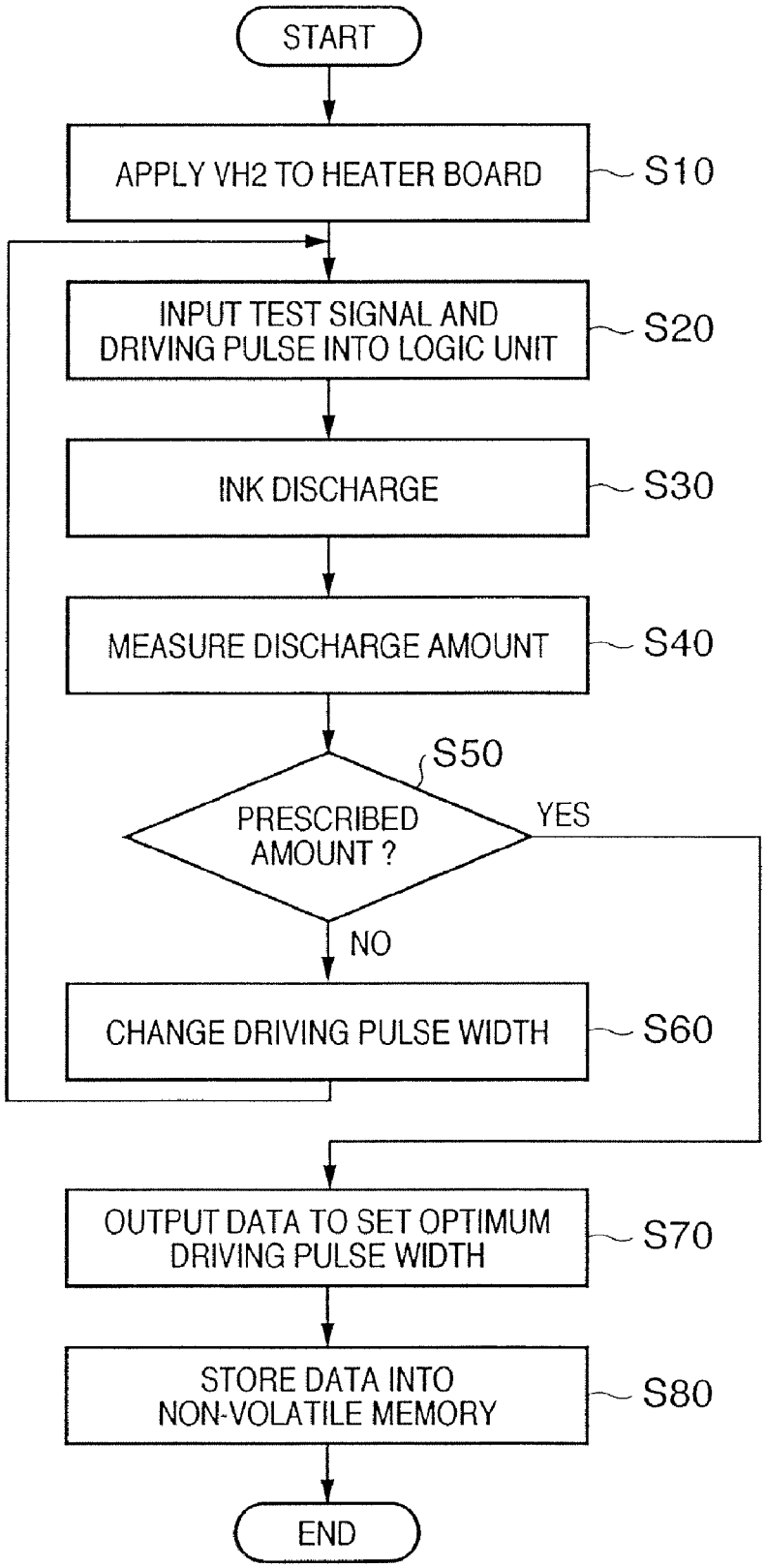
FIG. 5 is a flowchart showing a procedure of testing method using the test circuit 770.

Next, a procedure of testing method using the test circuit 770 will be described with reference to the flowchart of FIG. 5.

First, at step S10, the head driving voltage VH2 generated in the head test power source 771 is applied via the power line 105 and the GND line 106 to the heater board 752 in the printhead 3.

Further, at step S20, a test signal 112 to sequentially drive the plural printing elements in the printhead 3 is inputted from the test print signal generation circuit 783 into a logic unit 753 on the heater board 752, and at the same time, a driving pulse 111 with a predetermined width is inputted from the driving pulse generation circuit 782 into the logic unit 753 on the heater board 752.

At step S30, the printhead 3 receives these signals and the head driving voltage VH2, then the respective printing elements are sequentially driven and ink is discharged from the nozzles of the respective printing elements. Then at step S40, the amount of discharged ink is measured.

At step S50, it is examined whether or not the measured ink amount is a prescribed amount. If the measured value is not the prescribed amount, the process proceeds to step S60, at which the driving pulse width outputted from the driving pulse generation circuit 782 is changed, then the process returns to step S20. In this manner, the driving pulse width is controlled such that the measured ink amount becomes the prescribed amount. On the other hand, if it is determined at step S50 that the measured value is the prescribed amount, the process proceeds to step S70, at which the driving pulse width corresponding to the prescribed ink amount is determined as an optimum pulse width, and data 110 to set the pulse is outputted from the driving pulse generation circuit 782.

Then at step S80, the data 110 outputted from the driving pulse generation circuit 782 is stored into the non-volatile memory 751.

Note that in a case where the data stored in the non-volatile memory 751 is data to set the driving voltage, the driving pulse 111 outputted from the driving pulse generation circuit 782 has a constant pulse width. The head driving voltage VH2 generated by the head test power source 771 is changed such that the measured ink discharge amount becomes the prescribed amount. Then, data to set the determined driving voltage by the above control is stored into the non-volatile memory 751.

In this test upon manufacturing, the driving data to optimize the driving energy is set in correspondence with the discharge characteristic of each printhead.

As described above, the printing apparatus according to the present embodiment is provided with control means for optimizing the driving energy in correspondence with the discharge characteristic of printhead. The output voltage (VH2) from the head test power source 771 used in the test device and the output voltage (VH1) from the head driving power source 721 in the printing apparatus must match with each other or must accurately be balanced. More specifically, the driving energy is overapplied by the tolerance value of error between the voltages VH1 and VH2. However, such an excess of driving energy badly influences the life span of the printhead, accordingly, the reduction of error between the voltages VH1 and VH2 is an important issue in development of printhead.

Generally, the error tolerance value is about ±0.2 to 0.3 V. For example, if VH=20 V holds as the driving voltage (VH), the accuracy is 1% to 5%. To ensure this accuracy, conventionally a head test power source 771' of the test device and a head driving power source 721' of the printing apparatus respectively perform high accuracy control as shown in FIGS.

Figure 10:
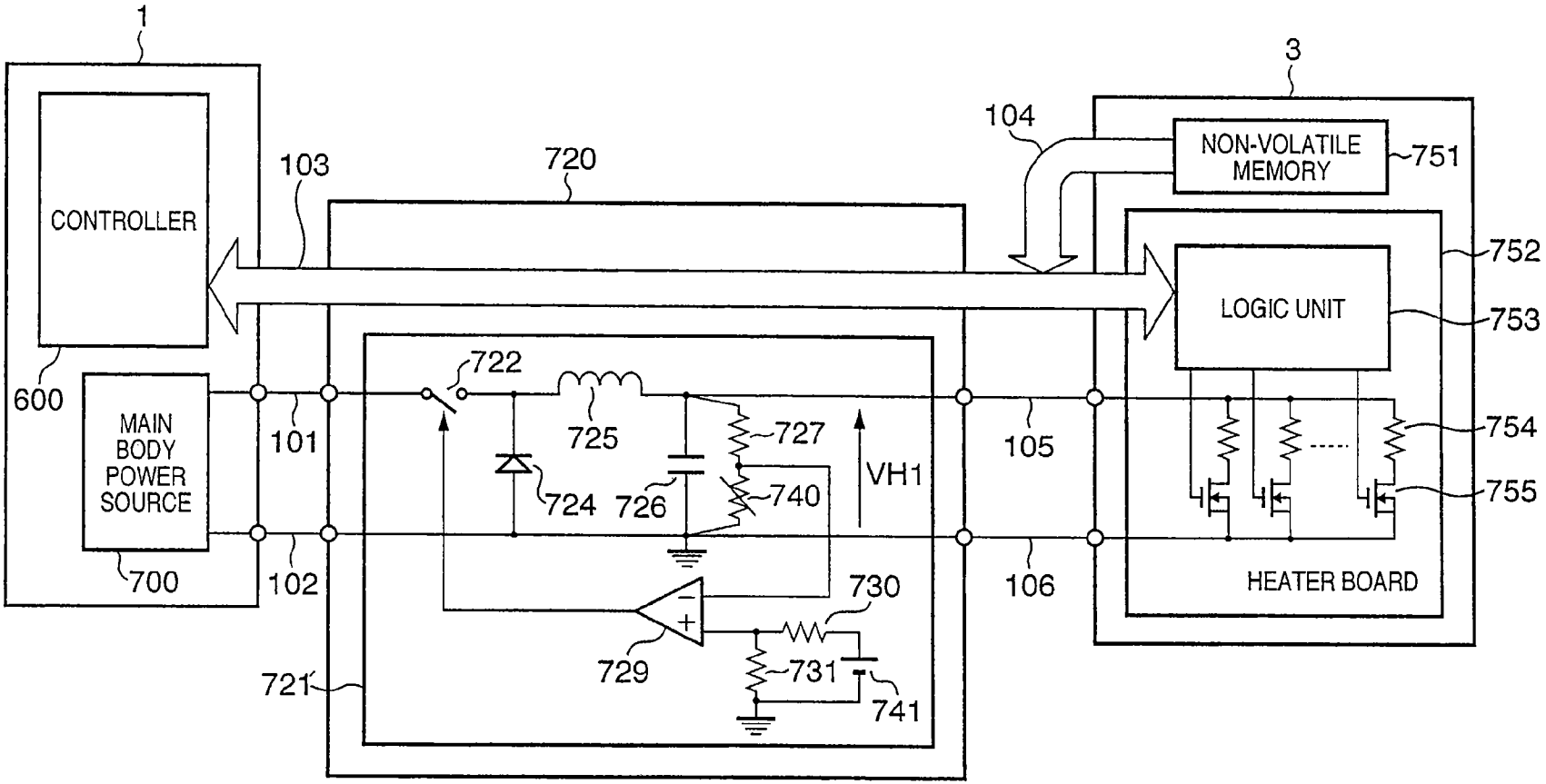
FIG. 10 is a block diagram showing the construction of a conventional printing apparatus.
Figure 11:
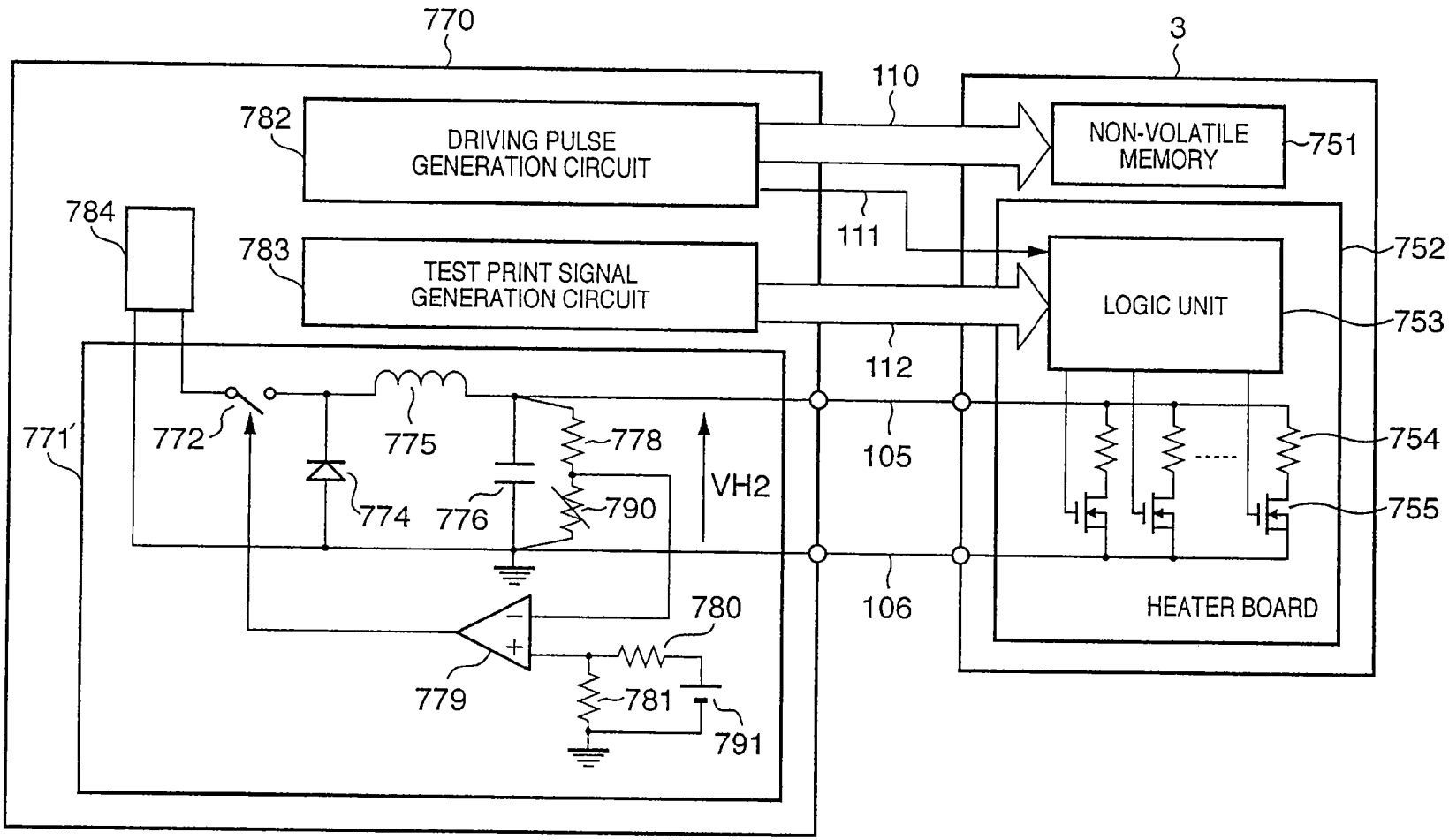
FIG. 11 is a block diagram showing the constructions of a conventional test device to control driving energy to optimize the discharge characteristic upon manufacturing a printhead and the printhead.

10 and 11. FIGS. 10 and 11 are block diagrams showing the constructions of a conventional printhead, a conventional carriage board and a conventional test device. Note that in FIGS. 10 and 11, the elements corresponding to those in the present embodiment shown in FIGS. 3 and 4 have the same reference numerals and the explanations thereof will be omitted.

As it is apparent from the above constructions, the conventional printhead internally lacks a reference voltage source, rather, the reference voltage sources 741 and 791 are provided inside the carriage board of the printing apparatus and the test device. The control of driving voltage is performed by variable resistors 740 and 790.

The above error tolerance value can be realized with the control process and it is preferable that this value can be further reduced.

On the other hand, in the present embodiment, the resistors having 0.5% accuracy to the above prescribed resistor value are used in the head test power source 771 of the test device and the head driving power source 721 of the printing apparatus, thereby the error of driving energy is reduced to 1% or lower. Thus, reduction of the error can be realized without any control.

The features of the present invention described with the above embodiment are as follows.

In a reference voltage (band-gap voltage) using a general semiconductor process, the accuracy up to ±2% is obtained. Accordingly, if a Chopper type Buck Converter as shown in FIG. 3 or a series regulator using the reference voltage is employed, the variation in reference voltage corresponds with variation in output voltage. In other words, if the variation in the reference voltage is 2%, that of the output voltage is 2%.

Accordingly, in the conventional method requiring output voltage accuracy of 1.0 to 1.5%, selection of reference voltage source or control means using variable resistors (740 and 790 in FIGS. 10 and 11) are indispensable, which increases the costs of the printhead and the printing apparatus, and further, a process of controlling the head driving power is required upon manufacturing the printhead.

On the other hand, in the present embodiment described above, the variations are caused only by the variations in resistor values, and further, the error in the output voltage is reduced by the voltage dividing ratio.

Further, as the resistor device is a very low price device, even the resistors requiring accuracy of about 0.5% do not greatly increase the total cost of the printhead and the printing apparatus. Further, as long as relative accuracy of output voltage is ensured, the requirement for the absolute accuracy of the reference voltage may be relaxed. If so, lower cost devices can be employed.

Figure 6:
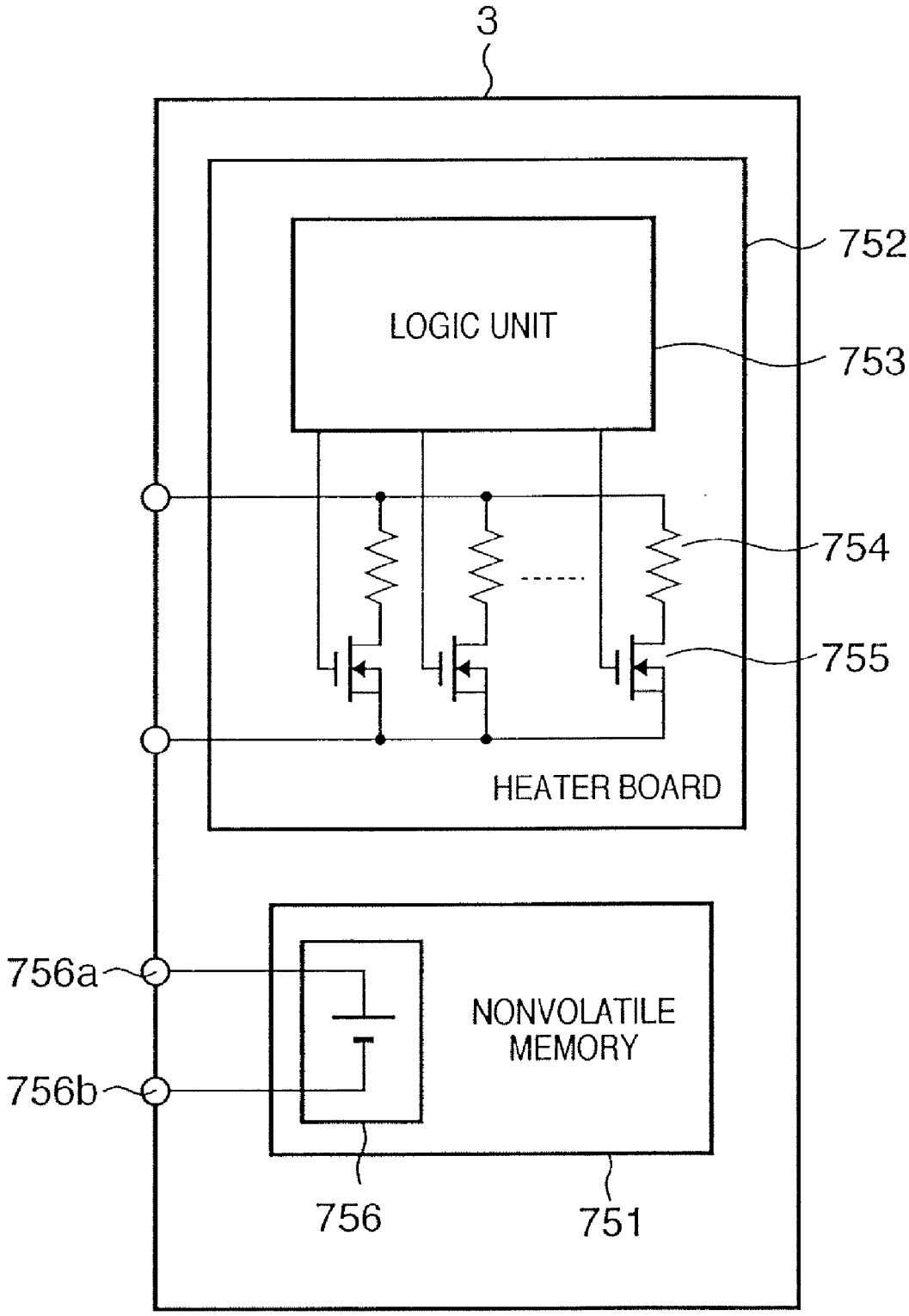
FIG. 6 is a block diagram showing another construction of the printhead.
Figure 7:
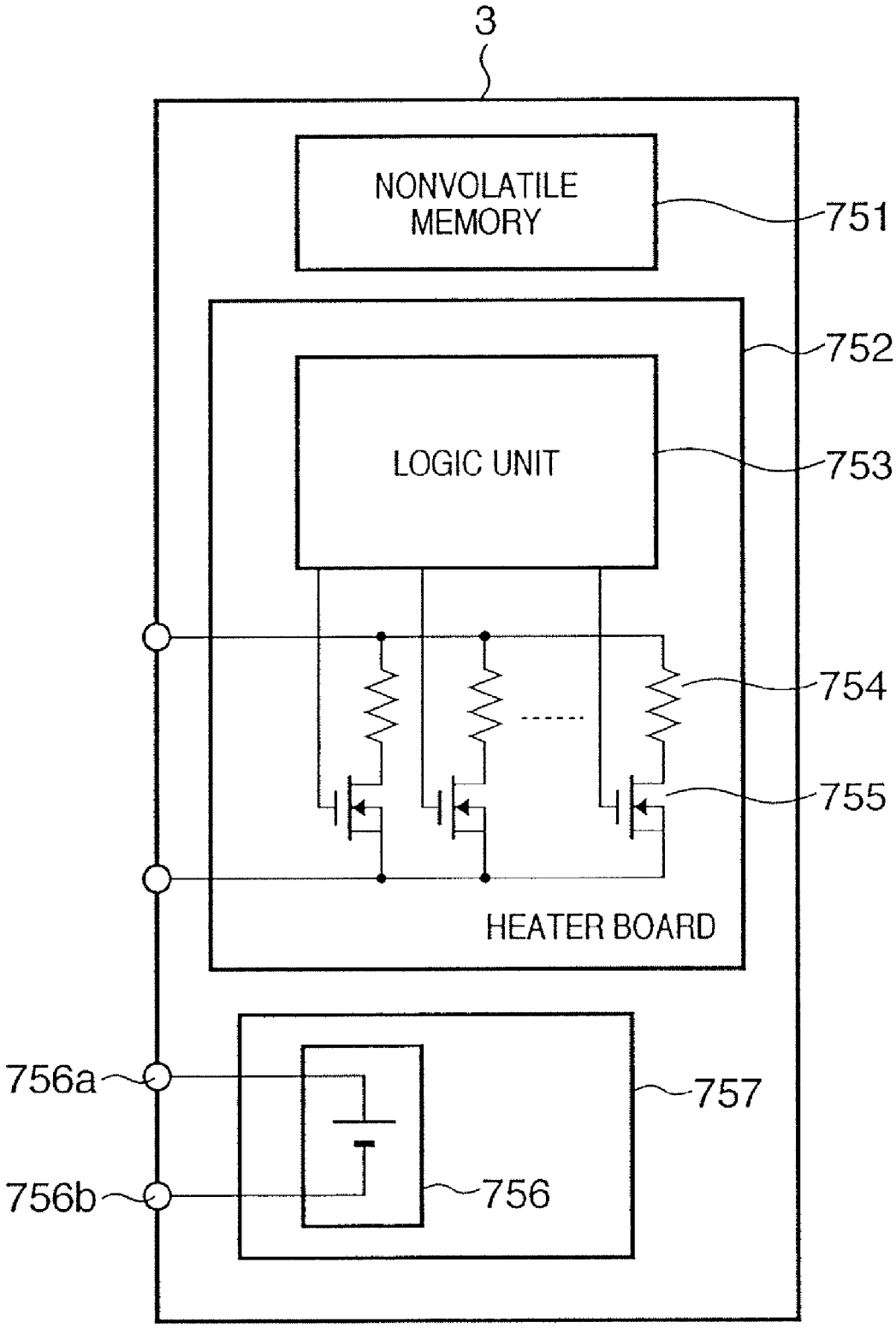
FIG. 7 is a block diagram showing the construction of a test device to test the printhead having the construction in FIG. 6.

Note that in the above-described embodiment, as shown in FIGS. 3 and 4, the reference voltage source 756 is provided inside the heater board 752, however, the position of the reference voltage source is not limited to inside the heater board 752. FIGS. 6 and 7 show another construction of the printhead. As shown in FIG. 6, the reference voltage source may be included in the non-volatile memory 751 in the printhead 3. Alternatively, as shown in FIG. 7, it may be provided on a semiconductor chip 757 other than the heater board 752 and the non-volatile memory 751.

Figure 8:
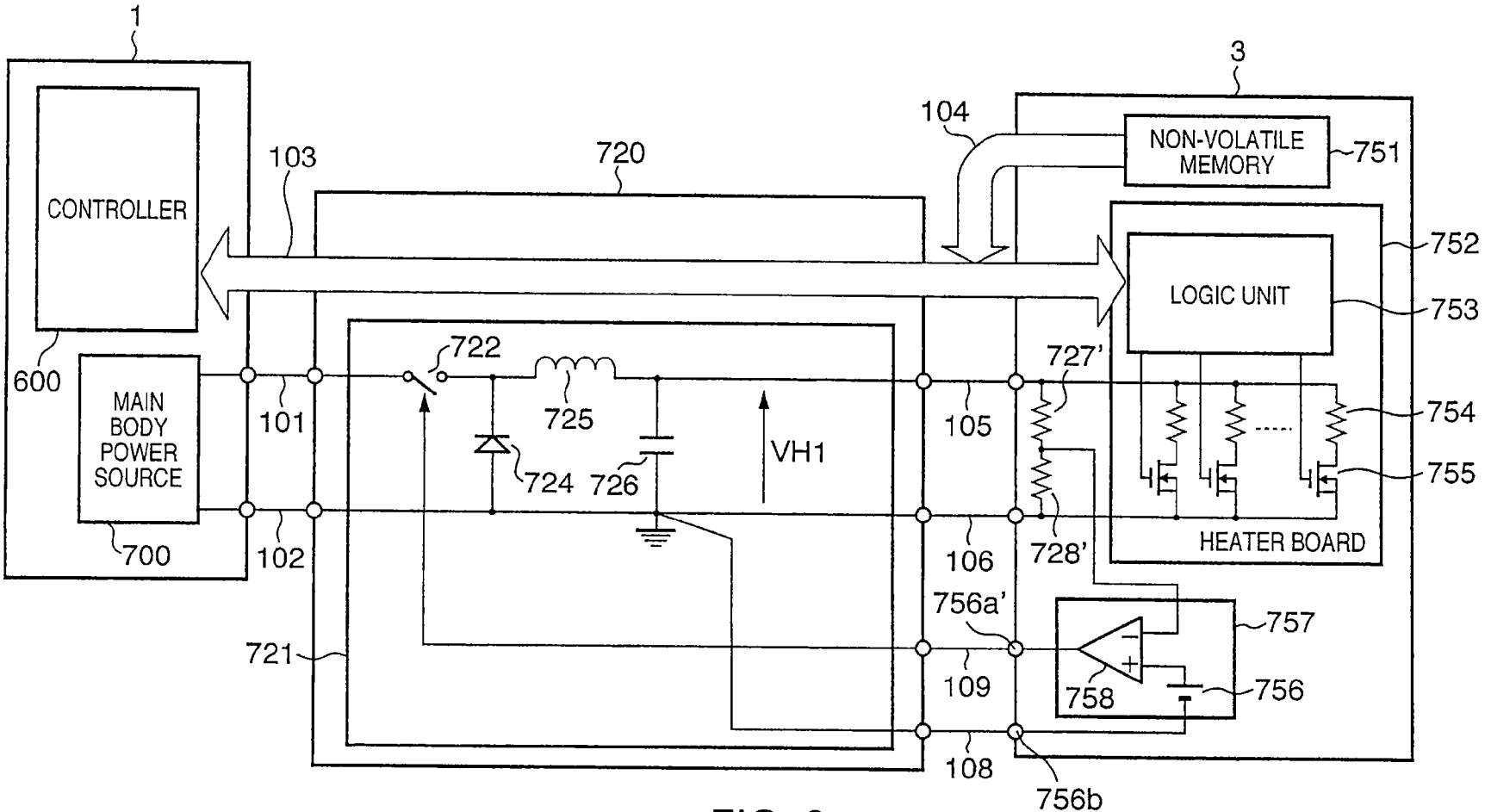
FIG. 8 is a block diagram showing still another construction of the printhead.
Figure 9:
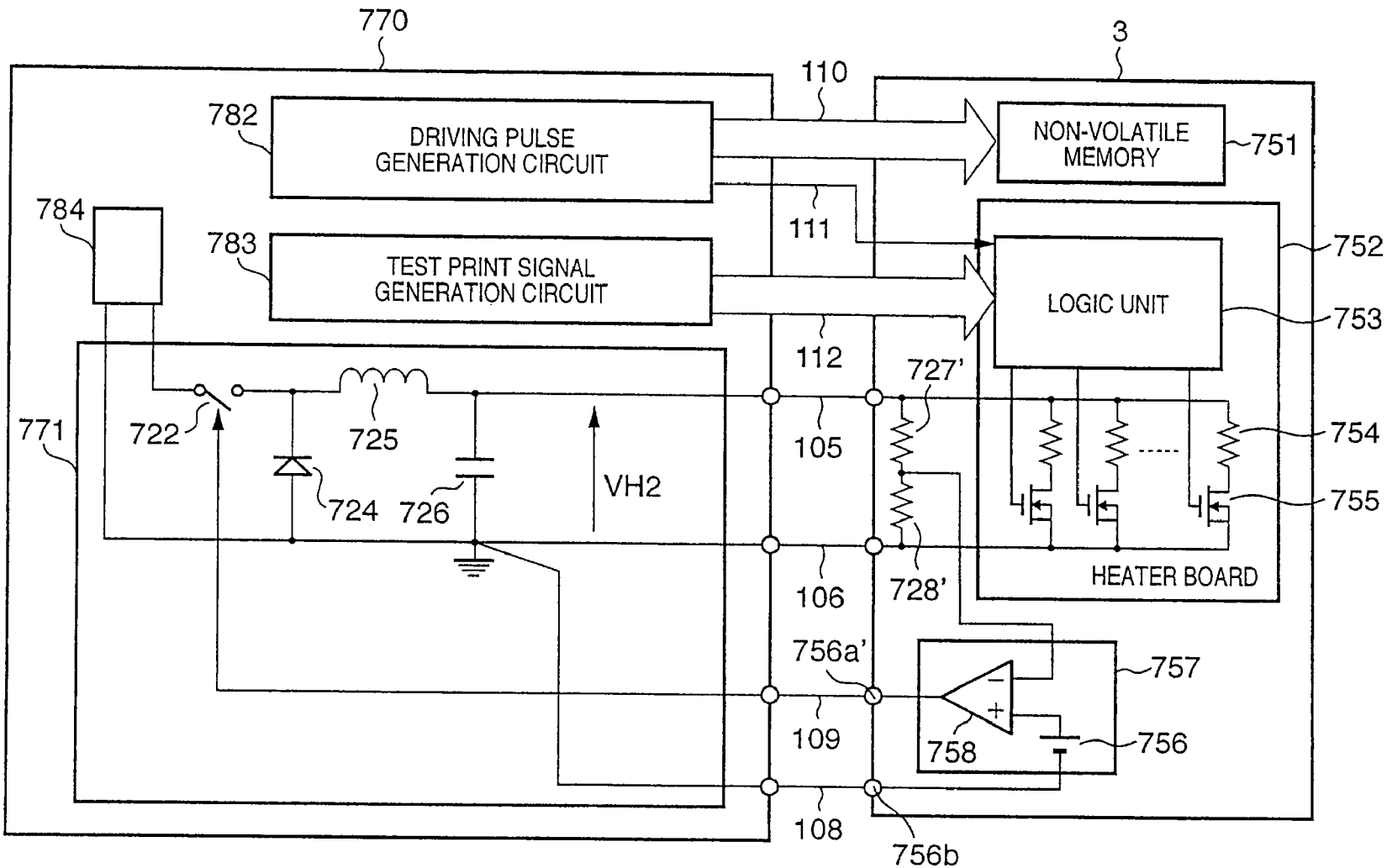
FIG. 9 is a block diagram showing the construction of the test device to test the printhead having the construction in FIG. 8.

Further, in the above-described embodiment, as shown in FIGS. 3 and 4, the reference voltage source is provided within the printhead, however, the present invention is not limited to this arrangement. For example, as shown in FIGS. 8 and 9, the differential amplifier and resistors to divide the output voltages (VH1 and VH2) may be provided, in addition to the reference voltage source, within the printhead. Note that in this arrangement, as the circuit operations and means for setting the driving energy are the same as those in the above embodiment, the explanations thereof will be omitted.

In the construction as shown in FIGS. 8 and 9, the error between the output voltage (VH2) from the head driving power in the test device 770 and the output voltage (VH1) from the head driving power source in the printing apparatus 1 can be eliminated. This greatly suppresses the oversupply of driving energy, thus further contributes to extending the life span of the printhead.

Note that in FIGS. 8 and 9, numerals 727' and 728' denote resistors similar to the resistors 727 and 728 for division of output voltages; 758, a similar differential amplifier to the differential amplifier 779; 757, a semiconductor chip on which the reference voltage source 756 and the differential amplifier 758 are packaged; and 756*a*, an output terminal.

Further, the above-described embodiment is merely illustrative, and the present invention is not limited to this construction. For example, the head driving power source 721 may be provided, not on the carriage board 720, but in the controller on the printing apparatus main body side. Further, the head driving power source 721 and the head test power source 771 may not be Chopper type Buck converters but may be series regulators, otherwise, may be Booster Converters or AC/DC power sources. Further, the means for storing the value to set optimum driving energy in the printhead may not be a non-volatile memory but may be a bar code or resistor array, otherwise, may be means for trimming the value or means for trimming an electrostatic capacitance value.

Further, in the above-described embodiment, the printhead is provided with one heater board, however, the present invention is not limited to this arrangement. The printhead may be provided with plural heater boards. In this case, only one reference voltage source may be provided in the printhead or one of plural reference voltage sources may be selected for setting the voltage of the head test power source in the test device and the head driving voltage in the printing apparatus, otherwise, respective reference voltage sources for the heater boards may be used for setting the voltage of the head test power source in the test device and the head driving voltage in the printing apparatus.

Note that in a case where the respective heater boards, obtained from the same lot, have the same structure as in the case of a color printhead, it may be arranged such that a reference voltage from one of the group of heater boards is used for generating driving power and the same voltage is applied.

The above description has been made about a thermal inkjet printing apparatus using electrothermal transducers, however, the present invention is also applicable, as means for controlling a printhead driving voltage circuit and driving pulse width, to a pulse-driven piezo inkjet printing apparatus.

Note that in the above embodiments, the liquid discharged from the printhead has been described as ink, and the liquid contained in the ink tank has been described as ink. However, the liquid is not limited to ink. For example, the ink tank may contain processed liquid or the like discharged to a print medium to improve fixability or water repellency of a printed image or to increase the image quality.

The above-described embodiment is based on a particular method, among the inkjet printing methods, of providing means for generating thermal energy as energy utilized for ink discharge, and discharging ink by causing film boiling in the heat acting surface of ink with the thermal energy.

As a pulse driving signal to be applied to the printhead, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

Further, in the above embodiment, a serial type printer for performing printing by scanning a printhead is used, however, as a full line type printhead having a length corresponding to the width of a maximum printing medium may be employed. As the full line type printhead, either an arrangement which satisfies the full-line length by combining a plurality of printheads as disclosed in the specification of the above patents or the arrangement as a single printhead obtained by integrally forming printheads can be used.

In addition, not only a cartridge type printhead in which an ink tank is integrally arranged on the printhead itself described in the above embodiment, but also an exchangeable chip type printhead, which can be electrically connected to the apparatus main unit and can receive ink from the apparatus main unit upon being mounted on the apparatus main unit, can be applicable to the present invention.

As many apparently widely different embodiments of the present invention can be made without departing from the spirit and scope thereof, it is to be understood that the invention is not limited to the specific embodiments thereof except as defined in the appended claims.

Claim of Priority

This application claims priority under 35 U.S.C. 119 from Japanese Patent Application No. 2003-287139 filed on Aug. 5, 2003, the entire contents of which are incorporated herein by reference.

What is claimed is:

1. A printhead driving method for driving an inkjet printhead having plural printing elements, a reference voltage source capable of outputting a reference voltage and a non-volatile memory for storing data indicating a pulse width of a drive signal for driving the plural printing elements, wherein the inkjet printhead is mounted to a printing apparatus or a printhead test device, the inkjet printhead further comprising a voltage dividing circuit for dividing a voltage supplied from the printing apparatus or the printhead test device, and a differential amplifier for comparing the voltage divided by the voltage dividing circuit with the reference voltage from the reference voltage source and outputting a signal based on a result of the comparison, the printing apparatus and the printhead test device each including a power supply circuit having a similar construction, and each power supply circuit is operable in a manner such that a difference between the divided voltage and the reference voltage is eliminated, said method comprising the steps of:

mounting the inkjet printhead to the printhead test device;

supplying a voltage based on the signal outputted from the differential amplifier and a drive signal having a pulse width based on data set in the printhead test device to the inkjet printhead;

measuring an ink amount discharged from the inkjet printhead;

storing the data indicating the pulse width with which the drive signal is used for driving the inkjet printhead into the non-volatile memory;

removing the inkjet printhead from the printhead test device and mounting the printhead to the printing apparatus; and supplying the voltage based on the signal outputted from the differential amplifier and the drive signal based on the data indicating the pulse width stored in the non-volatile memory to the inkjet printhead.

2. The method according to claim 1, wherein the reference voltage from the reference voltage source is a band-gap voltage provided in a semiconductor of the non-volatile memory.

* * * * *